United States Patent [19]

Meguro et al.

[11] 4,450,421

[45] May 22, 1984

[54] DIELECTRIC FILTER

[75] Inventors: Takeshi Meguro; Yukio Ito, both of Kawasaki, Japan

[73] Assignee: Fujitsu Limited, Kawasaki, Japan

[21] Appl. No.: 393,534

[22] Filed: Jun. 30, 1982

[30] Foreign Application Priority Data

Jun. 30, 1981 [JP] Japan ..... 56-100520

[51] Int. Cl.[3] ..... H01P 1/205; H01P 7/00

[52] U.S. Cl. ..... 333/202; 333/203; 333/219; 333/235

[58] Field of Search ..... 333/202–212, 333/219–235, 245, 248, 253; 334/41–45

[56] References Cited

U.S. PATENT DOCUMENTS 3,505,618 4/1970 McKee ..... 333/203
4,179,673 12/1979 Nishikawa et al. ..... 333/202 X
4,255,729 3/1981 Fukasawa et al. ..... 333/219 X
4,386,328 5/1983 Masuda et al. ..... 333/202
4,410,868 10/1983 Meguro et al. ..... 333/203

OTHER PUBLICATIONS

Matthaei–"Microwave Filters, Impedance-Matching Networks and Coupling Structures", McGraw-Hill Book Company, New York, 1964, pp. 497–506.

*Primary Examiner*—Marvin L. Nussbaum
*Attorney, Agent, or Firm*—Staas & Halsey

[57] ABSTRACT

A comb-line type dielectric filter in which a plurality of resonator holes are made in a dielectric block at predetermined intervals and coupling adjustment holes are made between the resonator holes, the interior surfaces of the resonator holes and the surface of the dielectric block being entirely or partly covered with a conductor film. The coupling adjustment holes are disposed apart from the line joining the centers of the resonator holes, and a coupling adjusting member made of metal or dielectric material is inserted into each coupling adjustment hole.

9 Claims, 25 Drawing Figures

DIELECTRIC FILTER

BACKGROUND OF THE INVENTION

The present invention relates to a dielectric filter, and more particularly to the arrangement of coupling adjustment holes in a comb-line type dielectric filter.

Heretofore there has been proposed a comb-line type dielectric filter in which a plurality of holes are made in a dielectric block and the interior surfaces of the holes and other required surface portions of the block are covered with conductor layers to constitute resonators of resonance frequencies dependent on the depths of the holes, as set forth in U.S. Pat. No. 3,505,618. As compared with a conventional filter formed by arranging a plurality of semi-coaxial or coaxial type resonators in a metal case, the comb-line type dielectric filter is highly advantageous in that it is small, lightweight and stable mechanically and electrically. On the other hand, the comb-line type dielectric filter is defective in that adjustment of the resonance frequencies of the coupling between adjacent ones of the resonators is difficult because electromagnetic fields are concentrated in the block as the dielectric constant increases. Especially the coupling adjustment is almost impossible to preform. For this reason, many efforts have been made to eliminate the necessity of adjustment of the filter by reducing dispersion in the quality of the dielectric material used and in improving the working accuracy of the material. As a result of this, the dielectric material becomes very expensive, and hence is not suitable for mass production.

As a solution to such a problem, there has been recently proposed in U.S. patent application Ser. No. 279,461 filed on July 1, 1981, now U.S. Pat. No. 4,410,868, such a filter structure that coupling adjustment holes, not covered with the conductor layer, are formed in the block intermediate between adjacent ones of the resonator holes, thereby to facilitate the coupling adjustment. With the provision of such coupling adjustment holes, however, coupling between adjacent resonators markedly increases. The reason is that the distance (electrical length) between the resonators decreases equivalently as a result of the removal of the dielectric from the portion where each coupling adjustment hole is formed. When the coupling intensity increases, the resonator holes must be spaced a large distance apart so as to obtain a predetermined coupling intensity, resulting in the filter becoming bulkier than in the case of no coupling adjustment holes being formed. This could be avoided by reducing the sizes of the coupling adjustment holes to suppress an increase in the coupling intensity as much as possible. In such a case, however a high degree of working accuracy is required for the necessity of raising the accuracy of the diameters of the coupling adjustment holes, their spacing and the positions of coupling adjusting screws so that the screws may be smoothly inserted into the holes. Especially, it is difficult to make thin and long holes in a hard dielectric material, and this leads to lowered productivity. Moreover, screws that are too thin are not mechanically sturdy and difficult to handle, imposing severe limitations on the reduction of the sizes of the coupling adjustment holes.

SUMMARY OF THE INVENTION

Accordingly, the present invention is directed to a comb-line type dielectric filter which is free from the abovesaid defects of the prior art.

In concrete terms, it is an object of the present invention to provide a comb-line type dielectric filter which is small though it is provided with coupling adjustment holes.

Another object of the present invention is to provide a comb-line type dielectric filter which can be fabricated with less tight tolerances than in the prior art.

Another object of the present invention is to provide a comb-line type dielectric filter which is designed so that adjusting members of metal or dielectric may be detachably inserted into coupling adjustment holes, thereby to permit changing of the coupling intensity between adjacent resonators and hence facilitate adjustment of its filter characteristic.

Another object of the present invention is to provide a dielectric filter which is formed as a unitary structure and has large endurance against vibration and shock.

Yet another object of the present invention is to provide a dielectric filter which is small-sized, lightweight, stable mechanically and electrically and inexpensive.

Briefly stated, the comb-line type filter of the present invention has a plurality of resonator holes formed in a dielectric block at predetermined intervals and coupling adjustment holes, each made in the dielectric block between adjacent ones of the resonator holes, the interior surfaces of the resonator holes and required surface areas of the block, except the interior surfaces of the coupling adjustment holes, being each covered with a conductor film. The coupling adjustment holes are each disposed at a position deviated from the line joining the centers of the resonator holes.

The abovesaid and other objects and features of the present invention will become fully apparent from the following detailed description taken in conjunction with the accompanying drawings. The drawings are merely illustrative of the present invention and should not be construed as limiting the invention specifically to them.

DESCRIPTION OF THE PREFERRED EMBODIMENTS

Figure 1A:
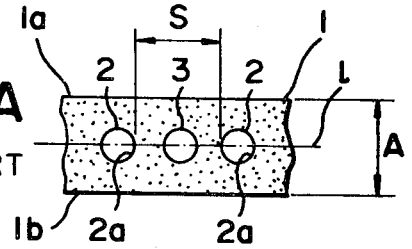
FIG. 1A PRIOR ART
FIGS. 1A and 1B are fragmentary diagrams schematically showing, by way of example, a conventional comb-line type dielectric filter.
Figure 1B:
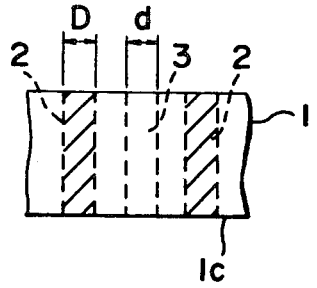
FIG. 1B PRIOR ART
Figure 2:
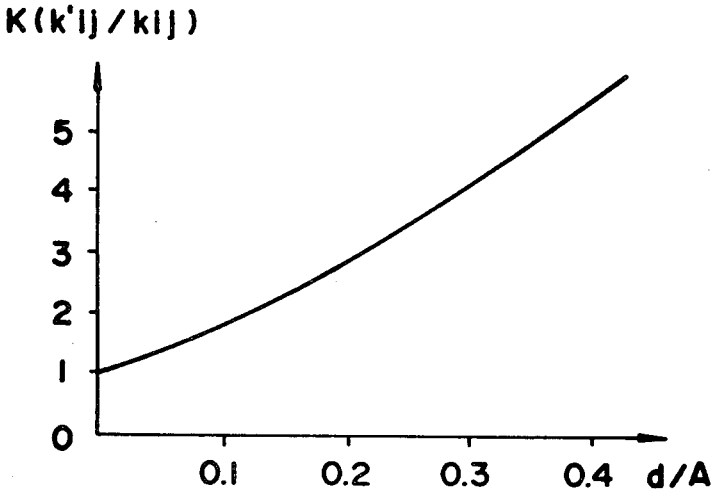
FIG. 2 is a graph showing a value K relative to d/A in the dielectric filter depicted in FIGS. 1A and 1B.

FIGS. 1A and 1B are respectively a top plan view and an elevation showing a prior art example of the comb-line type dielectric filter. In this filter, a plurality of through holes 2 of a depth which is a quarter wave length ($\lambda/4$, $\lambda$ being the working wavelength) or an odd-number multiple thereof are formed in a dielectric block 1 at predetermined intervals S, and through holes 3 are each formed in the dielectric block 1 intermediate between adjacent ones of the through holes 2 on the line joining the centers of the holes 2. The interior surface 2*a* of each hole 2 is covered with a conductor layer to form an inner conductor and opposite sides 1*a* and 1*b* and the bottom 1*c* of the block 1 are covered with a conductor layer to form an outer conductor. Thus, resonators whose resonance frequency is $\lambda/4$ or an odd-number multiple are constituted by the holes 2. The holes 3 are each situated halfway between the holes 2 and serve to adjust the coupling intensity between adjacent resonators. In this filter, the coupling intensity varies with the size of the hole 3 as shown in FIG. 2. Factors involved in this case are as follows:

A: Width of the block=13.5 mm

S: Spacing of the holes forming the resonators=10.1 mm (S/A=0.75)

D: Diameter of the holes forming the resonators=4.2 mm d: Diameter of coupling adjustment holes kij: Coupling coefficient between resonators in the case of d=0 k'ij: Coupling coefficient between resonators in the case of d≠0

K: k'ij/kij f: Working frequency=900 MHz $\epsilon_r$: Dielectric constant of the block=40

FIG. 2 shows K relative to d/A and, as will be seen from FIG. 2, the coupling coefficient k'ij markedly increases with an increase in the diameter d of the coupling adjustment hole 3.

Figure 3A:
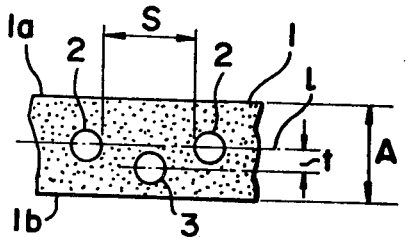
FIGS. 3A and 3B are fragmentary diagrams schematically illustrating an embodiment of the comb-line type dielectric filter of the present invention.
Figure 3B:
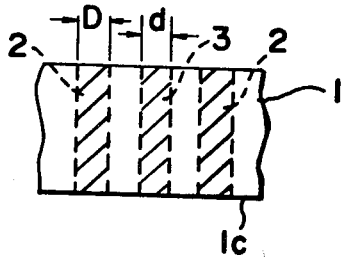
Figure 4:
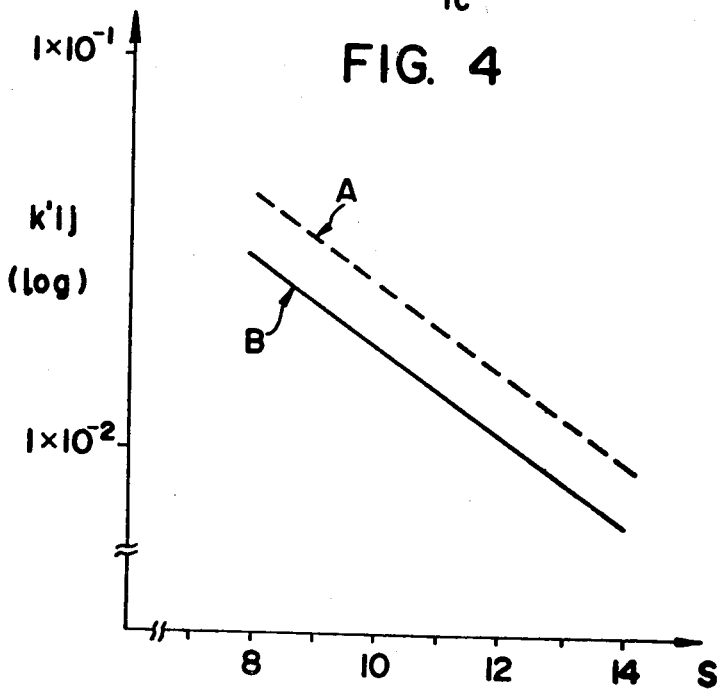
FIG. 4 is a graph showing the coupling coefficient k'ij of the filter of FIGS. 3A and 3B in comparison with the prior art example of FIGS. 1A and 1B.

FIGS. 3A and 3B are respectively a top plan view and an elevation illustrating an embodiment of the comb-line type dielectric filter of the present invention, which is identical in basic construction with the prior art example of FIGS. 1A and 1B and in which the parts corresponding to those in FIGS. 1A and 1B are therefore identified by the same reference numerals. The filter of the present invention has its feature in that the coupling adjustment holes 3 are each spaced a distance t from the line l joining the centers of adjacent resonator holes 2 as depicted in FIGS. 3A and 3B. With such an arrangement, the coupling coefficient k'ij between the resonators in the case of the coupling adjustment holes 3 being of the same diameter d is smaller than in the prior art example shown in FIGS. 1A and 1B. FIG. 4 shows this concretely, the abscissa representing S and the ordinate k'ij (on a log scale). The broken line A indicates the prior art example (t=0) of FIGS. 1A and 1B and the solid line B the embodiment of the present invention (t=2 mm) of FIGS. 3A and 3B in the case where d=D=4.2 mm. As will be apparent from FIG. 4, the coupling coefficient in the embodiment of the present invention (the solid line B) is ten-odd percent smaller than the coupling coefficient in the prior art example (the broken line A).

As described above, according to the present invention, by forming each coupling adjustment hole apart from the line joining the centers of the resonator holes, the coupling intensity between the resonators can be reduced as compared with the coupling intensity in the prior art even if the size of the coupling adjustment hole remains unchanged. In other words, if the diameter of the coupling adjustment hole is unchanged, the filter can be made smaller than in the past corresponding to the value by which the coupling intensity is lower. On the other hand, if the coupling intensity is unchanged, the coupling adjustment hole can be made larger; therefore, the machining accuracy need not be so close as has been required in the past.

Figure 5A:
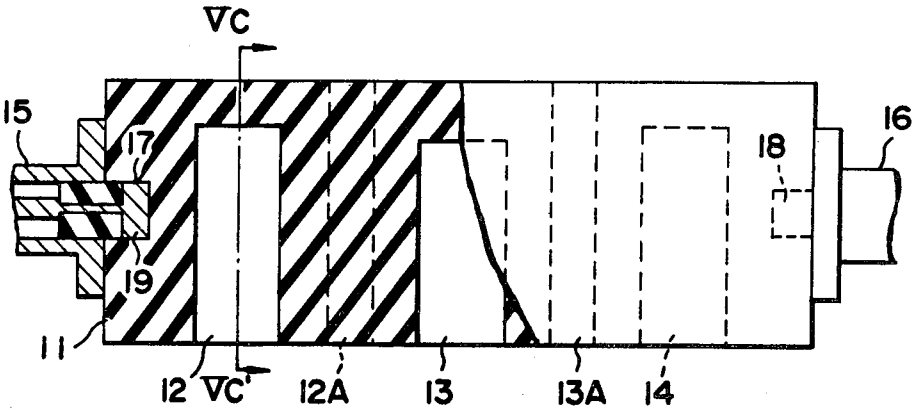
FIGS. 5A to 5C, illustrate another embodiment of the comb-line type dielectric filter of the present invention.
Figure 5B:
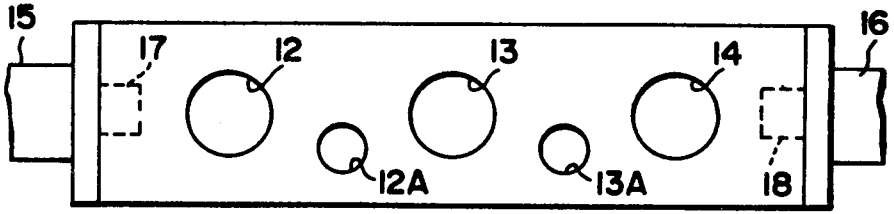
Figure 5C:
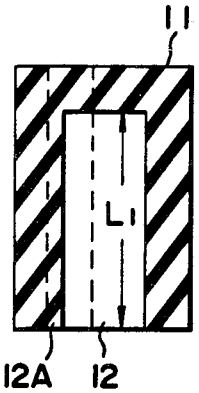

FIGS. 5A to 5C illustrate another embodiment of the present invention, FIG. 5A being an elevation partly cut away, FIG. 5B a bottom view and FIG. 5C a sectional view taken on the line C—C' in FIG. 5A.

This embodiment is directed to a three-section dielectric filter of a quarter wave or an odd number multiple thereof. As illustrated, holes 12, 13 and 14 are made in a dielectric block 11 as of ceramics with low loss to extend from the underside thereof, the depth $L_1$ of each hole being selected to be a quarter wavelength ($\lambda/4$, $\lambda$ being the working wavelength) or an odd number multiple thereof, and holes 12A and 13A are each made in the dielectric block 11 midway between adjacent ones of the holes 12, 13 and 14 but deviated from the line joining the centers of the holes. Further, holes 17 and 18 are made in the opposite sides of the dielectric block 11 for receiving coaxial connectors 15 and 16. The dielectric block 11 is metallized over the entire area of its surface except the interior surfaces of the holes 12A, 13A, 17 and 18.

With such an arrangement, the conductor layers on the interior surfaces of the holes 12, 13 and 14 serve as inner conductors and the conductor layer on the exterior surface of the dielectric block 11 serves as an outer conductor, constituting resonators whose resonance frequency is $\lambda/4$ or an odd number multiple thereof. The resonators are electromagnetically coupled through the dielectric material of the dielectric block 11, providing a three-section filter.

In FIG. 5A, reference numeral 19 indicates a metal disc, which is electromagnetically coupled with the resonator formed by the hole 12 and connected with a center conductor of a coaxial connector 15 for coupling an external connection line with the filter. Though not shown, s similar disc is also disposed in the hole 18 to couple the filter with an external connection line connected to a coaxial connector 16.

In this case, the holes 12A and 13A, each disposed midway between adjacent ones of the resonators formed by the holes 12, 13 and 14, are to adjust the resonance frequencies of the resonators and coupling between them. In the case where the coupling adjustment holes 12A and 13A are formed on the line joining the centers of the holes 12, 13 and 14, coupling between the resonators are liable to become tight. In this embodiment, however, since the coupling adjustment holes 12A and 13A are spaced from the line joining the centers of the holes 12, 13 and 14, coupling between the resonators does not become unnecessarily tight, ensuring to avoid that the filter becomes bulky.

According to the filter shown in FIGS. 5A to 5C, three resonators are constituted by forming the conductor layer over the entire area of the surface of the dielectric block 11 including the interior surfaces of the holes 12, 13 and 14, and their electrical shielding is provided by the conductor layer. Further, since the filter has a unitary block structure though it is composed of the three resonators, it is easy to fabricate and has large endurance against vibration and shock. Moreover, the formation of the external conductor layer eliminates the necessity of housing the filter in a metal case when it is put to use. Incidentally, the conductor layer can be formed by a desired metallization method.

Figure 6A:
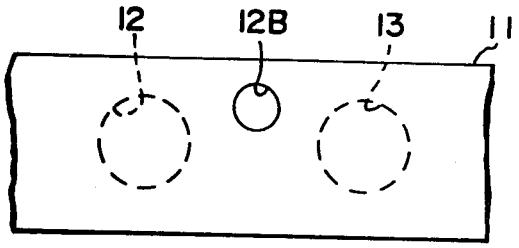
FIGS. 6A to 6D, illustrate another embodiment of the dielectric filter of the present invention.
Figure 6B:
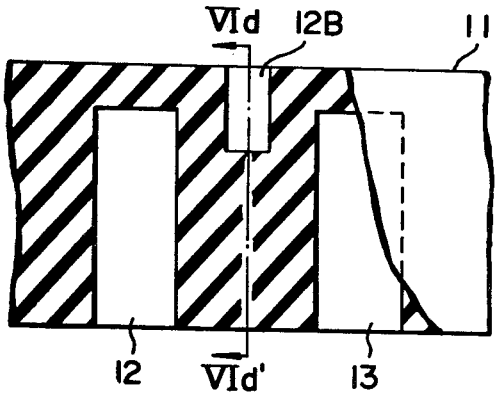
Figure 6D:
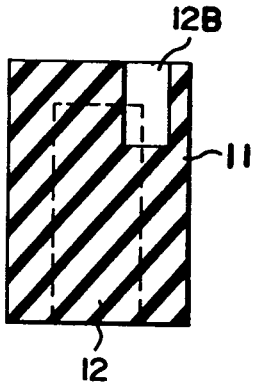
Figure 6C:
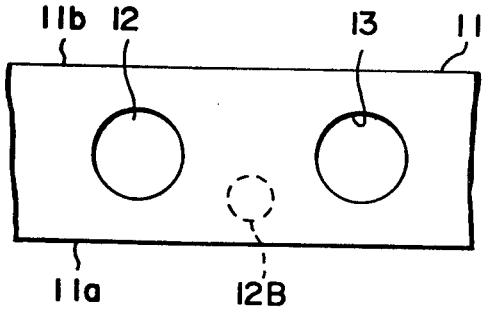

FIGS. 6A to 6D illustrate another embodiment of the dielectric filter of the present invention, FIG. 6A being a top plan view, FIG. 6B a partly cut away elevation, FIG. 6C a bottom view and FIG. 6D a sectional view taken on the line d—d' in FIG. 6B.

This embodiment shows only one part of the filter structure including the holes 12 and 13 in comparison with the embodiment of FIGS. 5A to 5C. This embodiment differs from the embodiment of FIGS. 5A to 5C in that the coupling adjustment holes, represented by 12B in this embodiment, are made in the dielectric block 11 on the opposite side from the holes 12 and 13 in a manner not to run through the dielectric block 11 as shown. The hole 12B is provided midway between the resonators 12 and 13 mainly for adjusting the coupling between them, and it is effective for this purpose to dispose the coupling adjustment hole at such a position where the electric field intensity between the resonators is high. Accordingly, the purpose can be sufficiently attained even if the coupling adjustment hole 12B is made relatively short so that it does not reach the side of the open ends of the resonators 12 and 13 as illustrated in FIGS. 6A to 6D. Also in this case, by disposing the hole 12B midway between the holes 12 and 13 at a position spaced from the line joining the centers of the holes 12 and 13 forming the resonators, it is possible to prevent that the coupling between the resonators becomes unnecessarily tight.

Figure 7A:
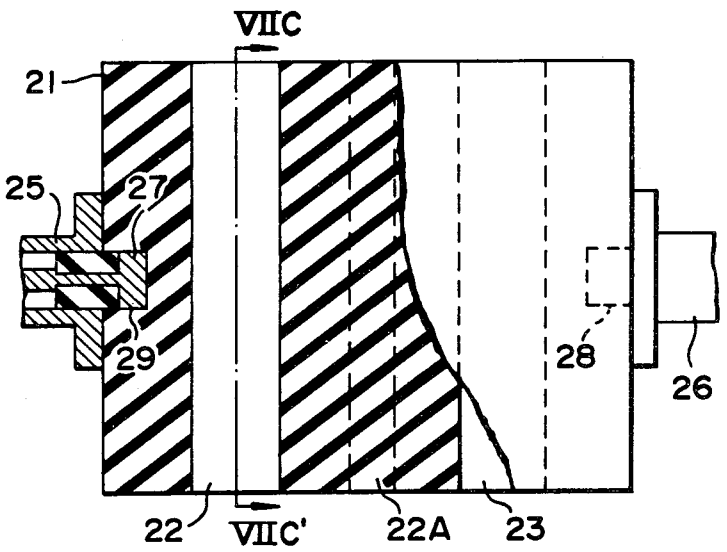
FIGS. 7A to 7C, illustrate another embodiment of the comb-line type dielectric filter of the present invention.
Figure 7B:
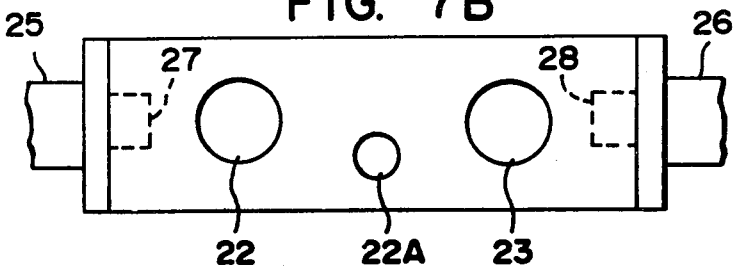
Figure 7C:
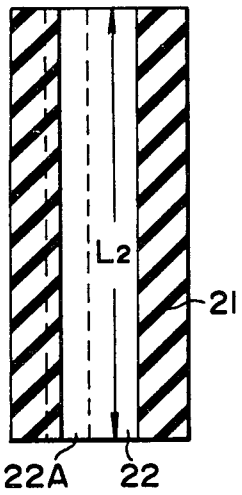

FIGS. 7A to 7C illustrate another embodiment of the dielectric filter of the present invention, FIG. 7A being a partly cut away elevation, FIG. 7B a bottom view and FIG. 7C a sectional view taken on the line C—C' in FIG. 7A. This embodiment is directed to a two-section dielectric filter of a frequency $\lambda/2$ or an integral multiple thereof. In a dielectric block 21, through holes 22 and 23 are made and their length $L_2$ is selected to be $\lambda/2$ or an integral multiple thereof. A hole 22A is made in the dielectric block 21 midway between the holes 22 and 23 at a position deviated from the line joining the centers of the holes 22 and 23. Holes 27 and 28 are made in the opposite sides of the dielectric block 21 for receiving connectors 25 and 26, respectively. The entire area of the surface of the dielectric block 21, except the interior surfaces of the holes 22A, 27 and 28, are metallized.

With such an arrangement, two resonators of a frequency $\lambda/2$ to an integral multiple thereof are constituted by the conductor layers coated on the interior surfaces of the holes 22 and 23, and a two-section filter is set up between the connectors 25 and 26 through the electric field coupling by metal discs as indicated by 29 in connection with the connector 25. Also in this case, coupling between the resonators does not become unnecessarily tight because the coupling adjustment hole 22A lies midway between the holes 22 and 23 at the position deviated from the line joining the centers of the holes 22 and 23.

Figure 8A:
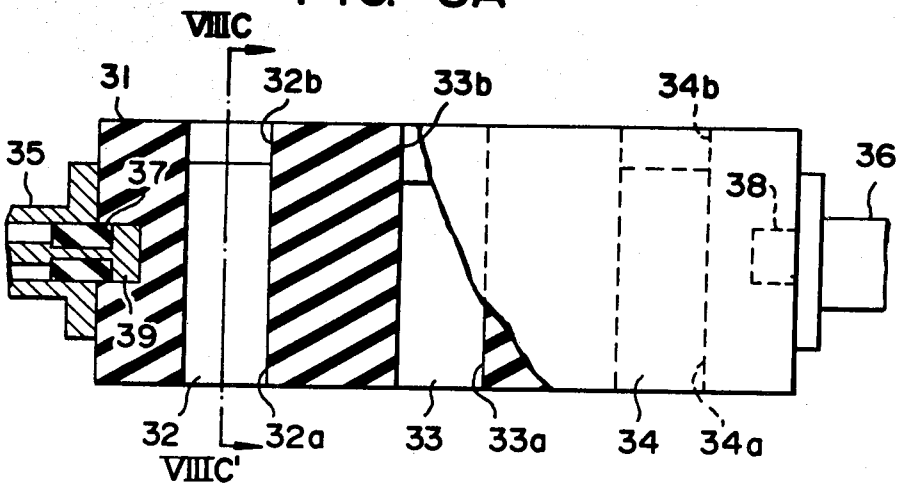
FIGS. 8A to 8C, illustrate still another embodiment of the comb-line type dielectric filter of the present invention.
Figure 8B:
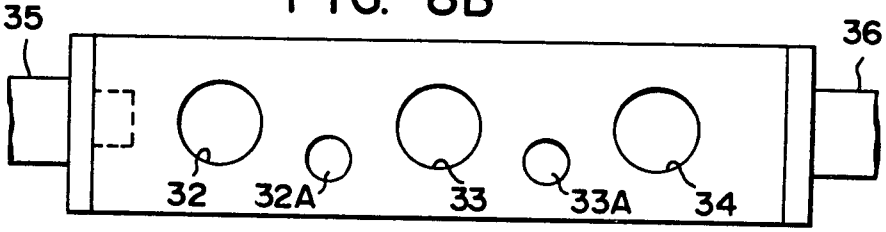
Figure 8C:
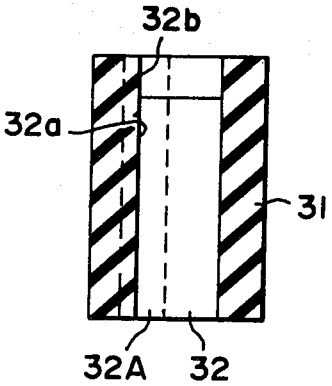

FIGS. 8A to 8C illustrate another embodiment of the dielectric filter of the present invention, FIG. 8A being a partly cut away elevation, FIG. 8B a bottom view and FIG. 8C a sectional view taken on the line C—C' in FIG. 8A. This embodiment is also directed to a dielectric filter of a frequency $\lambda/b$ 4 or an odd number multiple thereof similar to the filter shown in FIGS. 5A to 5C. In this embodiment, through holes 32, 33 and 34 are made in a dielectric block 31, and holes 32A and 33A are made in the dielectric block 31 midway between the holes 32 and 33 and between 33 and 34, respectively, at positions deviated from the line joining the centers of the holes 32, 33 and 34. Holes 37 and 38 are made in the opposite sides of the dielectric block 31 for receiving connectors 35 and 36, respectively. Further, the entire area of the surface of the dielectric block 31 is metallized except the interior surfaces of the holes 32A, 33A, 37 and 38 and selected portions **32*b*, 33*b* and 34*b* of the interior surfaces of the holes 32, 33 and 34. With such an arrangement, resonators of a frequency $\lambda/4$ or an odd number multiple thereof are constituted by the conductor layers formed on portions 32*a*, 33*a* and 34*a* of the interior surfaces of the holes 32, 33 and 34, and a three-section filter is established between the connectors 35 and 36 through the electric field coupling by metal discs such as indicated by 39 in connection with the connector 35. Also in this case, it is possible to prevent that the coupling between adjacent resonators becomes unnecessarily tight because the coupling holes 32A and 33A are disposed midway between the holes 32 and 33 and between 33 and 34 at the positions deviated from the line joining the centers of the holes 32, 33 and 34**.

In this embodiment, no conductor layers are formed on the portions **32*b*, 33*b* and 34*b* of the interior surfaces of the holes 32, 33 and 34 but this does not bring about any particular disadvantages since energy mostly tends to be stored in the dielectric block 31 when its dielectric constant is large. On the other hand, this embodiment has the advantage of easy formation of the holes over the embodiment of FIGS. 5A to 5C. Incidentally, the electrical shielding can be made more complete, as required, by closing the upper and lower open ends of the holes 32, 33 and 34** with conductor foil.

Figure 9A:
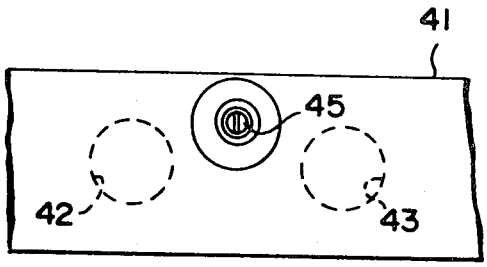
FIGS. 9A to 9C, illustrate a modified form of the dielectric filter of FIGS. 6A to 6D in which an adjusting member is disposed in each coupling adjustment hole so that the coupling between adjacent resonators can be varied as desired.
Figure 9B:
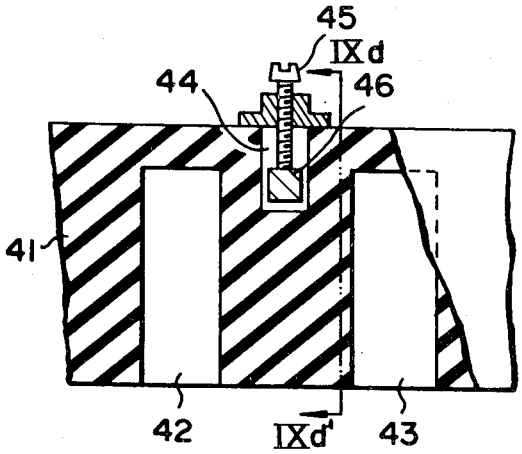
Figure 9C:
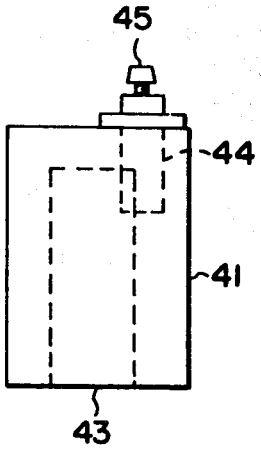

FIGS. 9A to 9C illustrate a modified form of the embodiment of FIGS. 6A to 6D, in which an adjusting member 46 is disposed in a coupling adjustment hole 44 so that the coupling between the resonators may be varied as desired. FIG. 9A is a top plan view, FIG. 9B a partly cut away elevation and FIG. 9C a side view. The adjusting member 46 may be made of metal or dielectric material, and it is designed so that its position in the hole 44 is adjustable by means of a screw 45. This embodiment permits fine control of the coupling between the resonators, and hence it facilitates adjustment of the filter characteristic and enables its enhancement. Also in this embodiment, since the coupling adjustment hole 44 is disposed midway between holes 42 and 43 at a position deviated from the line joining the centers of the holes 42 and 43 which form resonators, it is possible to prevent that the coupling between the resonators becomes unnecessarily tight.

Figure 10:
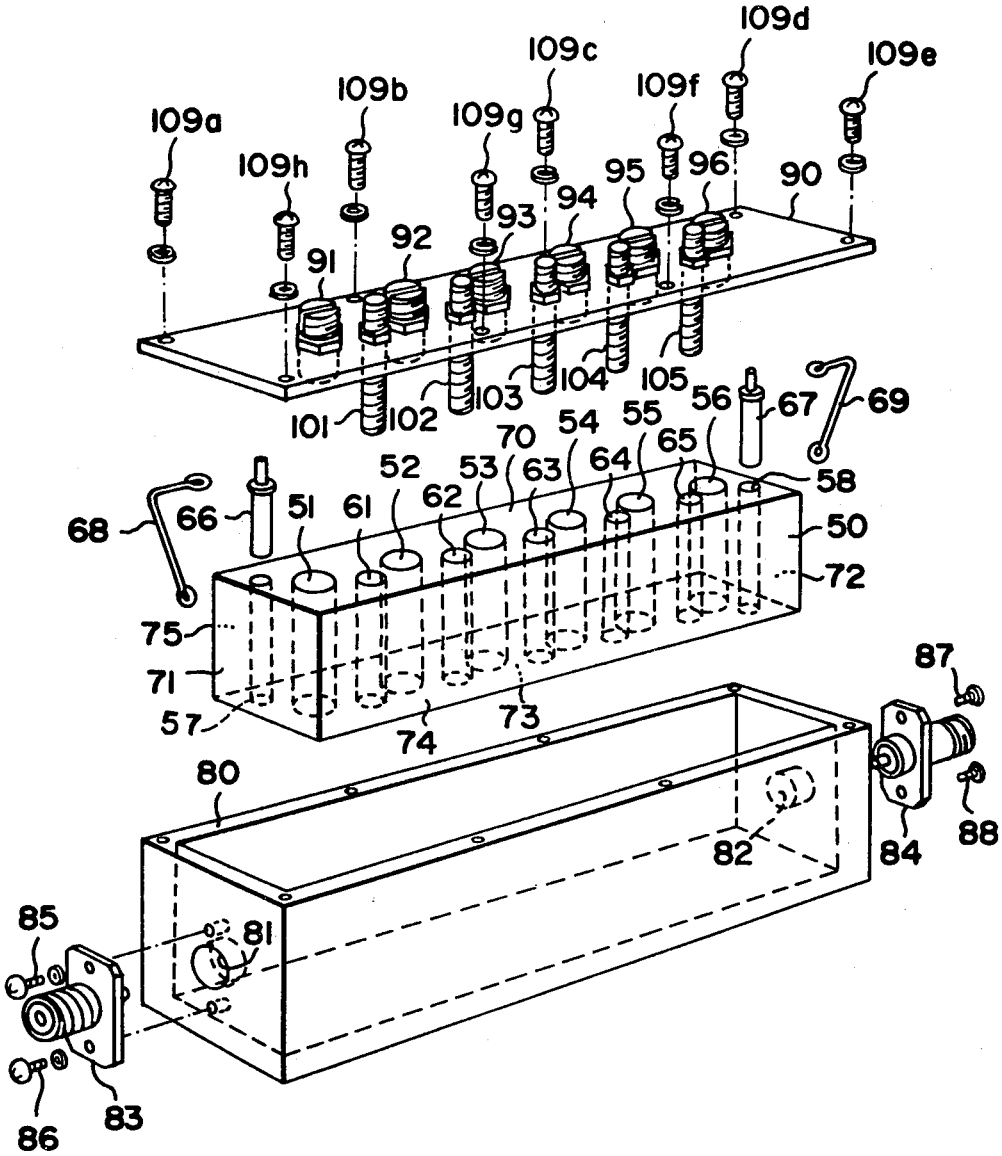
FIG. 10 is an exploded perspective view showing the specific arrangement of the dielectric filter of the present invention.

FIG. 10 is an exploded perspective view showing, by way of example, a specific arrangement of a six-section dielectric filter according to the present invention. In FIG. 10, reference numeral 50 indicates a dielectric block, which is made of, for instance, a Ti-Ba high dielectric constant material, and its specific inductive capacity $\epsilon_r$ is about 38. The dielectric block 50 has made therein six holes 51 to 56 for constituting resonators, holes 57 and 58 for input/output coupling use and five holes 61 to 65 for adjusting the coupling between adjacent ones of the resonators. The coupling adjustment holes 61 to 65 are each situated midway between adjacent ones of the resonator holes 51 to 56 at a position deviated from the line joining the centers of the resonator holes 51 to 56. The underside 73 and the opposite sides 74 and 75 of the dielectric block 50 and the interior surfaces of the holes 51 to 56 are each covered with a conductor layer of, for instance, an Ag-Pt thick film. The Ag-Pt thick film is about 15 μm. No conductor layers are formed on the top surface 70 and both end faces 71 and 72 of the dielectric block 50 and the interior surfaces of the holes 57, 58 and 61 to 65 and, consequently, the dielectric material is exposed there. As a result of this, the conductor layers deposited on the interior surfaces of the holes 51 to 56 serve as inner conductors and the conductor layer on the underside 73 and on both end faces 74 and 75 of the dielectric block 50 serves as an outer conductor. Thus, six λ/4 resonators are provided in which the top surface 70 of the dielectric block 50 is an open plane and the underside 73 thereof is a short-circuit plane, forming a six-section dielectric filter. In this case, metal rods 66 and 67 are inserted into the holes 57 and 58 and connected to central conductors of connectors 83 and 84 via connection lines 68 and 69, thereby achieving input/output coupling between the filter and external connection lines through electromagnetic coupling of the metal rods 66 and 67 with the resonators.

According to this embodiment, since the specific inductive capacity $\epsilon_r$ of the dielectric block is large, electromagnetic field energy generated by the resonators is mostly confined in the dielectric block 50, and the abovesaid structure can be utilized as a dielectric filter. Yet, since the top surface 70 of the dielectric block 50 is an open plane in which no conductive layer is formed, the electromagnetic field energy is emitted from there though very small in quantity. Reference numeral 80 indicates a metal case, in which the dielectric block 50 is housed and hermetically sealed with a lid 90 formed by a metal plate, suppressing the emission of the electromagnetic field energy. The metal case 80 may be a simple casing with rough dimensional tolerances by machinery cutting, plate working or the like. In both end portions of the metal case 80 there are made holes 71 and 72 for receiving connectors 83 and 84, which are fixed to the metal case 80 by means of screws 85 to 88. The metal case 80 and the conductor layer on the underside 73 of the dielectric block 50 are electrically and mechanically connected as by soldering.

The lid 90 has mounted thereon resonance frequency fine control screws 91 to 96 which are inserted into the holes 51 to 56 of the dielectric block 50 and coupling adjusting screws 101 to 105 which are inserted into the holes 61 to 65. The lid 90 is fixed by screws **109*a* to 109*h* to the metal case 80. With such an arrangement, the equivalent lengths of the inner conductors of the resonators vary with the depths to which the screws 91 to 96 are inserted into the holes 51 to 56; thus, the resonance frequencies of the resonators can be fine-controlled. Further, the coupling between adjacent ones of the resonators is adjusted in accordance with the amount of insertion of the screws 101 to 105 into the holes 61 to 65. Since the dielectric block 50 is completely surrounded by the metal case 80 and the lid 90, the filter of FIG. 10 is free from leakage of the electromagnetic field to the outside and is stably held electrically and mechanically, and hence it is stable in operation. Also in this case, the coupling adjustment holes 61 to 65 are each disposed apart from the line joining the centers of the resonator holes 51 to 56** as described previously, there is no possibility of the coupling between adjacent resonators becoming unnecessarily tight and, consequently, the dielectric filter is prevented from becoming bulky.

Figure 11:
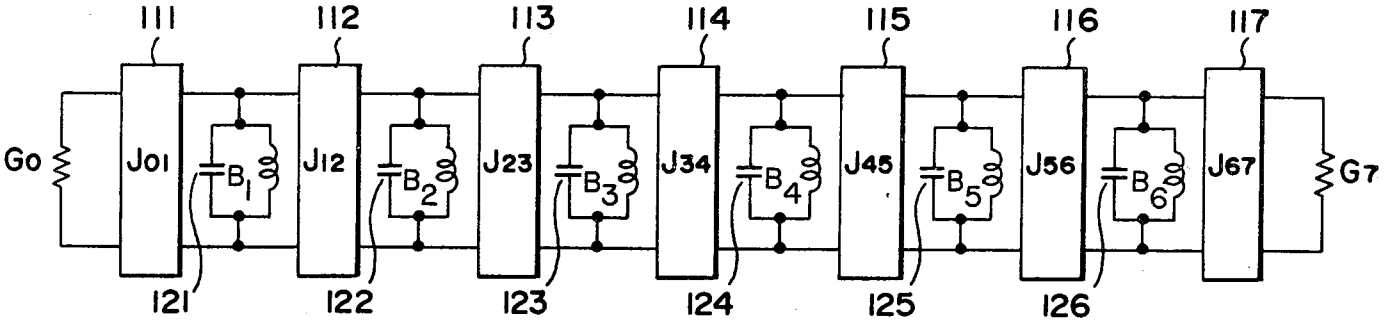
FIG. 11 shows an electrically equivalent circuit of the dielectric filter depicted in FIG. 10.

FIG. 11 shows an electric equivalent circuit of the dielectric filter of FIG. 10. In FIG. 11, reference characters $B_1$ to $B_6$ indicate susceptances of the resonators and, in the vicinity of the working frequency, each of them can be regarded as an L-C parallel resonance circuit as shown. Reference characters $J_{01}$ to $J_{67}$ designate parameters of admittance inverters 111 to 117 for converting the parallel resonance circuits to series resonance circuits and for converting Q inherent in each resonator to an external load Q necessary for achieving a desirable filter characteristic. The parameters $J_{01}$ to $J_{67}$ can be set to desired values by selecting the coupling strengths between the holes 57 and 51, between 51 and 52, between 52 and 53, between 53 and 54, between 54 and 55, between 55 and 56, and between 56 and 58, thereby achieving the required characteristics of the filter. The screws 101 to 105 in FIG. 10 are provided for fine control of the parameters $J_{01}$ to $J_{67}$. The screws 91 to 96 are to alter fringing capacitances between the end faces of the holes 51 to 56 and the tips of the screws, thereby changing capacitances 121 to 126 of the susceptances $B_1$ to $B_6$ to perform fine control of the resonance frequencies of the respective resonators. Reference characters $G_0$ and $G_7$ identify loads at input and output ends.

Figure 12:
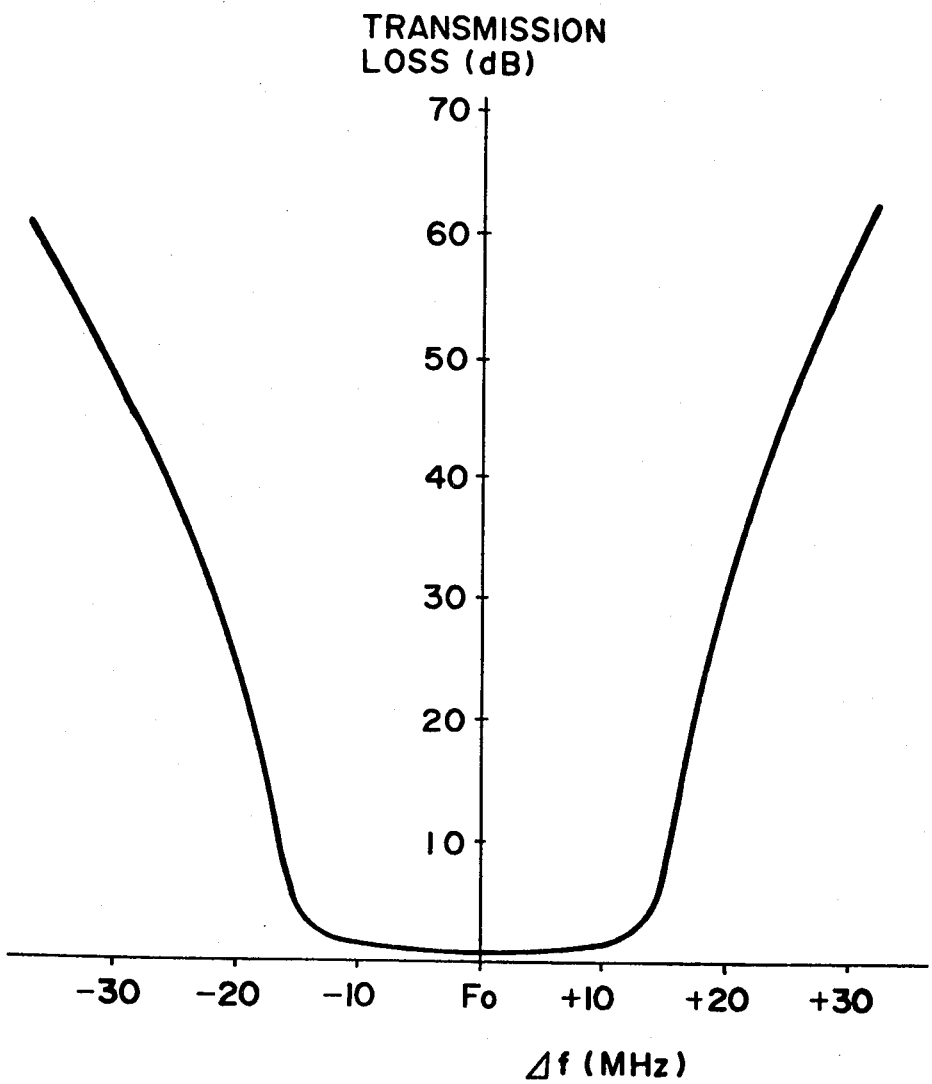
FIG. 12 is a graph showing, by way of example, the characteristic of the dielectric filter of the present invention.

FIG. 12 shows the characteristic of a six-section Tchbyscheff filter according to the embodiment of FIG. 10, with its center frequency $F_0$ set to 876 MHz. The abscissa represents frequency deviation Δf (MHz) from the center frequency $F_0$ and the ordinate transmission loss (dB). The characteristic shown is one that was obtained in the case where the dielectric block 50 in FIG. 10 was 13.5 mm in width and height and about 80 mm in length, the holes 51 to 56 and 61 to 65 were 4 mm in diameter and the holes 57 and 58 were 2.5 mm in diameter. The transmission loss was about 1.2 dB at the center frequency $F_0$. VSWR≦1.2, 6 dB and the bandwidth was 24 MHz.

The dielectric filter of the present invention is generally useful as a band-pass filter in the frequency range of the UHF band. Since the resonators are formed as a unitary structure by the dielectric block, the dielectric filter of the present invention is excellent in the resistance against vibration and shock, and it is easy to fabricate and small and lightweight. Accordingly, the filter of the present invention is of particular utility when employed as a diplexer for separating transmitted and received waves from each other in a mobile radio communication system, such as a vehicular radio communication system or the like.

It will be apparent that many modifications and variations may be effected without departing from the scope of the novel concepts of the present invention.

What is claimed is:

1. A dielectric filter comprising:

a dielectric block;

a plurality of resonator holes made in the dielectric block at predetermined intervals for forming resonators; and a hole made in the dielectric block between each adjacent pair of the resonator holes, for adjusting the coupling between the resonators, the interior surfaces of the resonator holes and the surface of the dielectric block, except the interior surface of each coupling adjustment hole, being at least partly covered with a conductor layer;

wherein each said coupling adjustment hole is disposed apart from the line joining the centers of the resonator holes.

2. A dielectric filter according to claim 1 wherein each said coupling adjustment hole extends through the dielectric block.

3. A dielectric filter according to claim 1 wherein each coupling adjustment hole is made in the dielectric block to a selected depth.

4. A dielectric filter according to claim 1 or 2 wherein a coupling fine control member is inserted into each said coupling adjustment hole in a manner to be adjustable in its position therein.

5. A dielectric filter according to claim 4 wherein each said coupling fine control member is made of metal.

6. A dielectric filter according to claim 4 wherein each said coupling fine control member is made of a dielectric material.

7. The filter of claim 1, each said resonator hole having a cylindrical portion of its interior surface at one end of the hole left uncoated.

8. The filter of claim 1, comprising a fine control screw at one of each said resonator hole for adjusting the frequency of the resonators.

9. The filter of claim 1, said resonator holes being formed from an opposite surface of said dielectric block than each said hole for adjusting the coupling, all of said holes only partially penetrating said block.

* * * * *

UNITED STATES PATENT AND TRADEMARK OFFICE

CERTIFICATE OF CORRECTION

PATENT NO. : 4,450,421

DATED : 22 May 1984

INVENTOR(S) : Meguro et al

It is certified that error appears in the above-identified patent and that said Letters Patent is hereby corrected as shown below:

Col. 1, line 22, after "frequencies" insert --or--;
line 27, "preform" should be --perform--.

Col. 3, line 62, "l" should be --ℓ--,

*Col. 4, line 58, "s" should be --a--.

Col. 6, line 13, "λ/b4" should be --λ/4--.

Signed and Sealed this

*Twenty-third* Day of *October 1984*

[SEAL]

*Attest:*

GERALD J. MOSSINGHOFF

*Attesting Officer*

*Commissioner of Patents and Trademarks*